US011130601B2

(12) United States Patent
Liao et al.

(10) Patent No.: US 11,130,601 B2
(45) Date of Patent: Sep. 28, 2021

(54) GAS-SEALED BODY WITH CUSHIONING FUNCTION

(71) Applicant: KUNSHAN AIRBAG PACKING CORP, Suzhou (CN)

(72) Inventors: Tai-An Liao, Suzhou (CN); Kao-Hsiung Liao, Suzhou (CN); Ping-Yuan Liao, Suzhou (CN)

(73) Assignee: KUNSHAN AIRBAG PACKING CORP, Suzhou (CN)

( * ) Notice: Subject to any disclaimer, the term of this patent is extended or adjusted under 35 U.S.C. 154(b) by 111 days.

(21) Appl. No.: 16/352,478

(22) Filed: Mar. 13, 2019

(65) Prior Publication Data

US 2019/0300215 A1 Oct. 3, 2019

(30) Foreign Application Priority Data

Mar. 28, 2018 (TW) ..... 107110816

(51) Int. Cl.

| | |
|---|---|
| ***B65B 31/00*** | (2006.01) |
| ***B65B 31/04*** | (2006.01) |
| ***B65B 41/16*** | (2006.01) |
| ***B65D 81/05*** | (2006.01) |

(52) U.S. Cl.

CPC ..... *B65B 31/043* (2013.01); *B65B 31/048* (2013.01); *B65B 41/16* (2013.01); *B65D 81/052* (2013.01); *B65B 2220/12* (2013.01); *B65B 2220/22* (2013.01); *B65B 2230/02* (2013.01)

(58) Field of Classification Search

CPC ... B65B 31/043; B65B 31/048; B65B 43/123; B65B 2220/12; B65B 2220/22; B65B 2230/02; B31D 5/0073

See application file for complete search history.

(56) References Cited

U.S. PATENT DOCUMENTS

| | | | | |
|---|---|---|---|---|
| 5,261,466 | A * | 11/1993 | Koyanagi | B31D 5/0073 141/10 |
| 9,138,960 | B1 * | 9/2015 | Liao | B65D 81/052 |
| 2010/0200169 | A1 * | 8/2010 | Sperry | B31D 5/0073 156/495 |
| 2017/0144402 | A1 * | 5/2017 | Liao | B65D 31/14 |
| 2019/0367251 | A1 * | 12/2019 | Liao | B29C 65/02 |

* cited by examiner

*Primary Examiner* — Chelsea E Stinson
(74) *Attorney, Agent, or Firm* — Rabin & Berdo, P.C.

(57) ABSTRACT

A gas-sealed body with cushioning function is adapted to be inflated by a processing machine. The processing machine includes an inflation bar and pressing wheels adjacent to the inflation bar. The inflation bar is to inflate the gas-sealed body. The pressing wheels roll on a rolling track of the gas-sealed body for conveying the gas-sealed body. The gas-sealed body includes an inflation channel, gas inlets, pillow structures, and gas chambers. Each gas chamber includes one or more gas inlets, one or more cushion-part gas column, and a main-part gas column. When each of the inflation inlets is inflated, the corresponding one or more cushion-part gas column and the corresponding main-part gas column are inflated and expanded in order.

10 Claims, 6 Drawing Sheets

GAS-SEALED BODY WITH CUSHIONING FUNCTION

CROSS-REFERENCE TO RELATED APPLICATION

This non-provisional application claims priority under 35 U.S.C. § 119(a) to Patent Application No. 107110816 filed in Taiwan, R.O.C. on Mar. 28, 2018, the entire contents of which are hereby incorporated by reference.

BACKGROUND

Technical Field

The instant disclosure relates to a gas-sealed body, in particular, to a gas-sealed body having cushion-part gas columns for facilitating the inflation process.

Related Art

Along with the developments of societies, logistics transportation becomes popular, and consumers are concerned about goods packaging and protection. Moreover, different electronics are developed continuously with increasing volumes. For example, during the logistic transportation of a large panel TV device or the like, these electronic devices may be damaged due to impacts on the device. Hence, how to protect large-sized objects becomes an issue.

SUMMARY

Regarding transportation and packaging for large-sized objects, a large-sized packaging bag known to the inventor is developed to package the large-sized objects for provide shock absorption and protection to the objects. On the other hand, a bag inflation apparatus uses pressing wheels to convey uninflated packaging bags to an inflation bar for inflating the packaging bags. For normal-sized packaging bags, the conveyance and the inflation of the packaging bags can be performed properly; however, when the bag inflation apparatus is used to inflate the large-sized packaging bag known to the inventor, the conveyance of the large-sized packaging bag cannot be performed properly. In detail, during the inflation and conveying process, the volume of the inflated portion of the packaging bag increases and the inflated portion of the packaging bag abuts against the pressing wheels. As a result, in the case that the pressing wheels are fixed with the apparatus, the pressing wheels cannot convey the inflated portion of the packaging bag, thereby the packaging bag deflecting from the conveying track. Moreover, since the packaging bag is already deflected from the conveying track, the uninflated portion of the packaging bag cannot be inflated, adversely affecting the production of the large-sized packaging bag known to the inventor.

Furthermore, since the positions of the pressing wheels of the bag inflation apparatus cannot be adjusted, the deflection of the packaging bag occurs frequently when the conveying track for the packaging bag is too narrow, and the apparatus may fail to convey the packaging bag when the conveying track for the packaging bag is too wide.

Therefore, how to develop a packaging bag suitable for the bag inflation apparatus to solve the aforementioned problems is an issue.

One embodiment of the instant disclosure provides a gas-sealed body with cushioning function. The gas-sealed body is adapted to be inflated by a processing machine. Wherein, the processing machine comprises an inflation bar and a plurality of pressing wheels adjacent to the inflation bar. The inflation bar is adapted to inflate the gas-sealed body. The pressing wheels are adapted to roll on a rolling track of the gas-sealed body for conveying the gas-sealed body. The gas-sealed body is formed by stacking two outer films and two inner films with each other, the inner films are between the outer films, and a length of each of the inner films is shorter than a length of each of the outer films. The gas-sealed body further comprises an inflation channel, a plurality of gas inlets, a plurality of pillow structures, and a plurality of gas chambers.

The inflation channel is formed between a first transversal heat-seal line and a second transversal heat-seal line of the gas-sealed body. The first transversal heat-seal line and the second transversal heat-seal line are not intersected with each other. The inflation channel comprises an inflation port, and the inflation bar is adapted to be put in the inflation port.

The gas inlets are formed between the two inner films. One of opposite surfaces of the two inner films has a heat-resistant area. After a heat-resistant material is coated on the heat-resistant area, the gas inlets are formed when the second transversal heat-seal line is formed by heat sealing. The gas inlets are at positions between the inner films and the positions correspond to the heat-resistant material, and the two inner films are not adhered with each other at positions having the gas inlets.

The pillow structures are formed by heat sealing and spaced apart from each other. Each of the gas inlets is located between two adjacent pillow structures. Each of the pillow structures comprises an upper pillow portion and a lower pillow portion connected to the upper pillow portion, the upper pillow portion is located in the heat-resistant area. A bottom portion of the lower pillow portion is connected to a rolling line of the gas-sealed body, and the rolling line is aligned transversally. A width range of the rolling track encompasses the rolling line and at least a portion of the inflation channel The pillow structures are adapted to be pressed by and positioned with the pressing wheels stably to allow a pressure from the pressing wheels to be distributed over the gas-sealed body when the pressing wheels roll on the pillow structures.

The gas chambers are formed by intersecting a plurality of longitudinal heat-seal lines with the second transversal heat-seal line. The longitudinal heat-seal lines are spaced apart from each other. Each of the gas chambers comprises at least one of the gas inlets, at least one cushion-part gas column, and a main-part gas column. The at least one cushion-part gas column is extending from the corresponding gas inlet toward the rolling line, and the main-part gas column communicates with the at least one cushion-part gas column at the rolling line. When the inflation bar inflates each of the inflation inlets, the at least one cushion-part gas column and the main-part gas column are inflated and expanded in order. The at least one cushion-part gas column provides a holding force for the pressing wheels when the pressing wheels roll on the gas-sealed body.

In one or some embodiments, the second transversal heat-seal line forms curved structures at the gas inlets.

In one or some embodiments, the width range of the rolling track further encompasses the first transversal heat-seal line.

In one or some embodiments, the heat-resistant material is coated on the heat-resistant area of one of the inner films in a continuous coating manner.

In one or some embodiments, the heat-resistant material is coated on the heat-resistant area of one of the inner films in a discontinuous coating manner.

In one or some embodiments, each of the longitudinal heat-seal lines comprises a first longitudinal heat-seal line portion and a second longitudinal heat-seal line portion, and a longitudinal tear line is between the first longitudinal heat-seal line portion and the second longitudinal heat-seal line portion.

In one or some embodiments, each of the pillow structures comprises a cushioning node.

In one or some embodiments, the shape of each of the pillow structures is a geometric shape.

In one or some embodiments, each of the pillow structures is of a rectangular shape, or a triangular shape, or a U shape, or a quadrilateral shape, or a V shape, or a combination comprising at least two of the foregoing.

In one or some embodiments, the gas-sealed body further comprises a plurality of heat-seal portions each adhered to the inner films and one of the outer films in the corresponding main-part gas column. Each of the heat-seal portions comprises a heat-seal point, or each of the heat-seal portions comprises a heat-seal line, or each of the heat-seal portions comprises a heat-seal point and a heat-seal line.

In one or some embodiments, top edge lines of the inner films are flush with top edge lines of the outer films, heights of the inner films are equal to heights of the outer films, and the inflation channel is formed between the inner films.

In one or some embodiments, top edge lines of the inner films are lower than top edge lines of the outer films, heights of the inner films are lower than heights of the outer films, and the top edge lines of the inner films are located in the inflation channel.

According to one or some embodiments of the instant disclosure, during the inflation, the pillow structures are to be pressed by and positioned with the pressing wheels of the processing machine stably and allow a pressure from the pressing wheels to be distributed over the gas-sealed body when the pressing wheels roll on the gas-sealed body. On the other hand, each of the gas chambers has at least one cushion-part gas column, and the cushion-part gas column has a smaller inflated volume. The cushion-part gas column provides the friction and the holding force for the pressing wheels. Therefore, the pressing wheels can convey the gas-sealed body properly. Hence, during the inflation of the gas-sealed body, the gas-sealed body can be conveyed along the track and not deflect off the track.

In other words, according to one or some embodiments of the instant disclosure, the pressing wheels press the gas-sealed body along the rolling track. The width range of the rolling track encompasses the rolling line and at least a portion of the inflation channel The cushion-part gas column is provided as a cushion structure for inflating and conveying the main-part gas column, and the pressing wheels are not in contact with the main-part gas column directly. Therefore, the pressing wheels can properly convey the gas-sealed body and both the inflated portion and the uninflated portion of the gas-sealed body can be smoothly conveyed.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
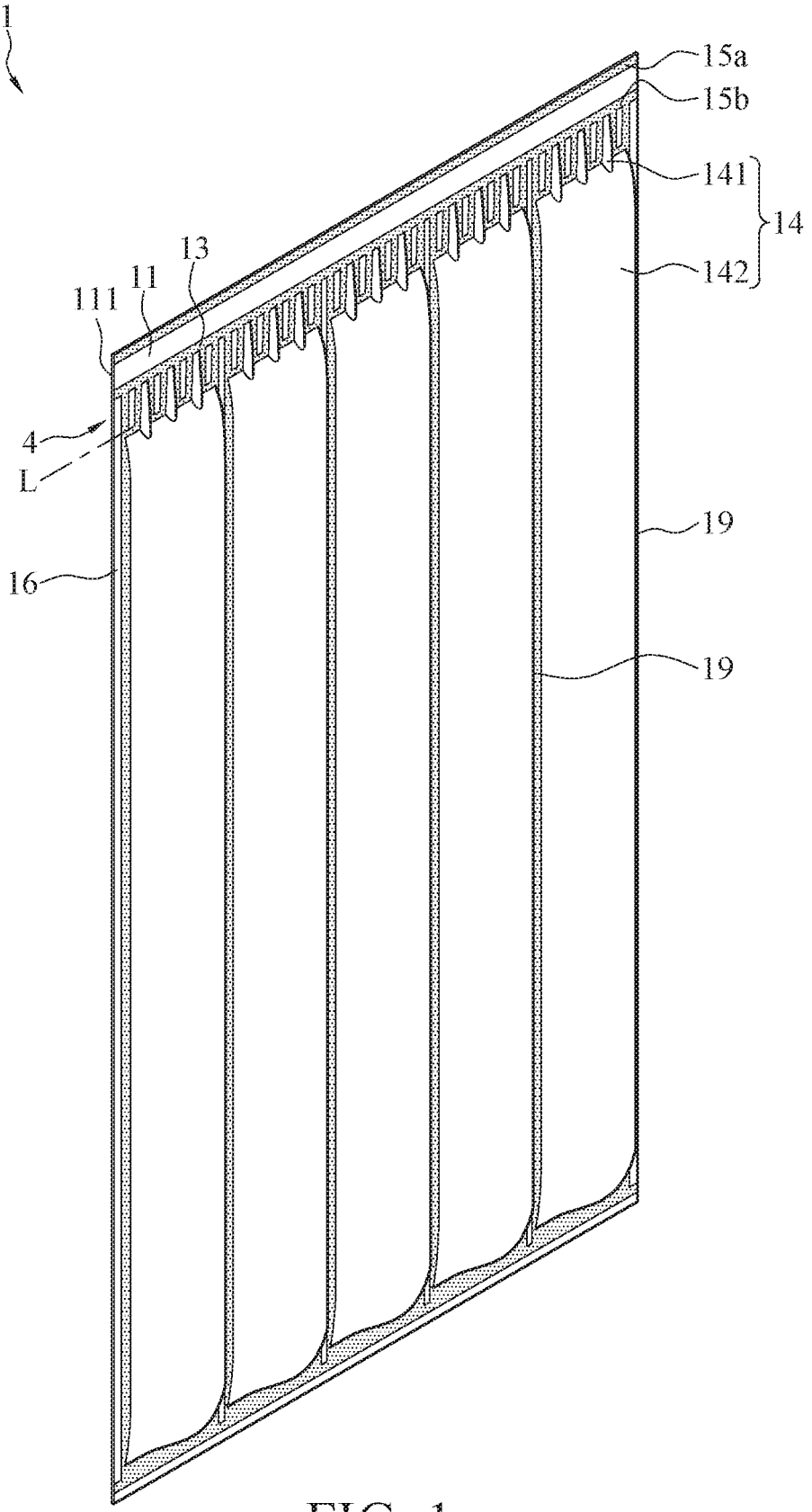
FIG. 1 illustrates a perspective view of a gas-sealed body according to one embodiment of the instant disclosure.

Please refer to FIG. 1 and FIGS. 2A to 2D. FIG. 1 illustrates a perspective view of a gas-sealed body 1 according to one embodiment of the instant disclosure. FIGS. 2A to 2D respectively illustrate partial schematic view of a gas-sealed body 1 according embodiments of the instant disclosure.

The gas-sealed body 1 is formed by stacking two outer films 16 and two inner films 17 with each other; the inner films 17 are between the outer films 16, and a length of each of the inner films 17 is shorter than a length of each of the outer films 16. The gas-sealed body 1 further comprises an inflation channel 11, a plurality of gas inlets 12, a plurality of pillow structures 13, and a plurality of gas chambers 14.

Figure 3:
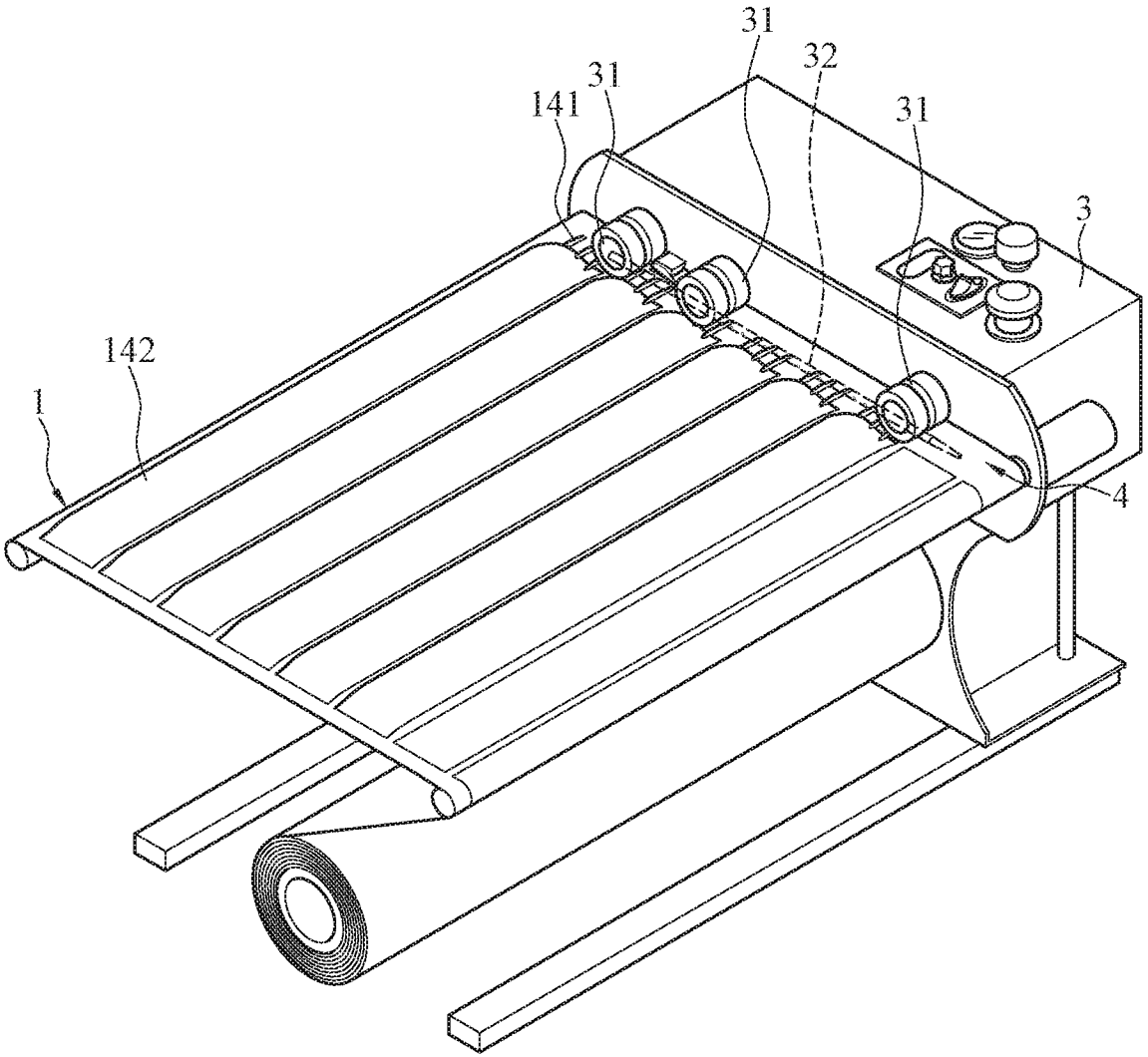
FIG. 3 illustrates a schematic operational view of a gas-sealed body according to one embodiment of the instant disclosure.

The inflation channel 11 is formed between a first transversal heat-seal line 15*a* and a second transversal heat-seal line 15*b* of the gas-sealed body 1. The first transversal heat-seal line 15*a* and the second transversal heat-seal line 15*b* are not intersected with each other, therefore the inflation channel 11 is formed therebetween. The inflation channel 11 comprises an inflation port 111, and an inflation bar 32 (as shown in FIG. 3) can be put in the inflation channel 11 through the inflation port 111 for inflating the gas-sealed body 1.

In one embodiment, the inflation channel 11 is formed between the two inner films 17. "A length of each of the inner films 17" and "a length of each of the outer films 16" indicates the length of each of the films (the inner films 17 and the outer films 16) along a length direction of the first transversal heat-seal line 15*a*.

Figure 2A:
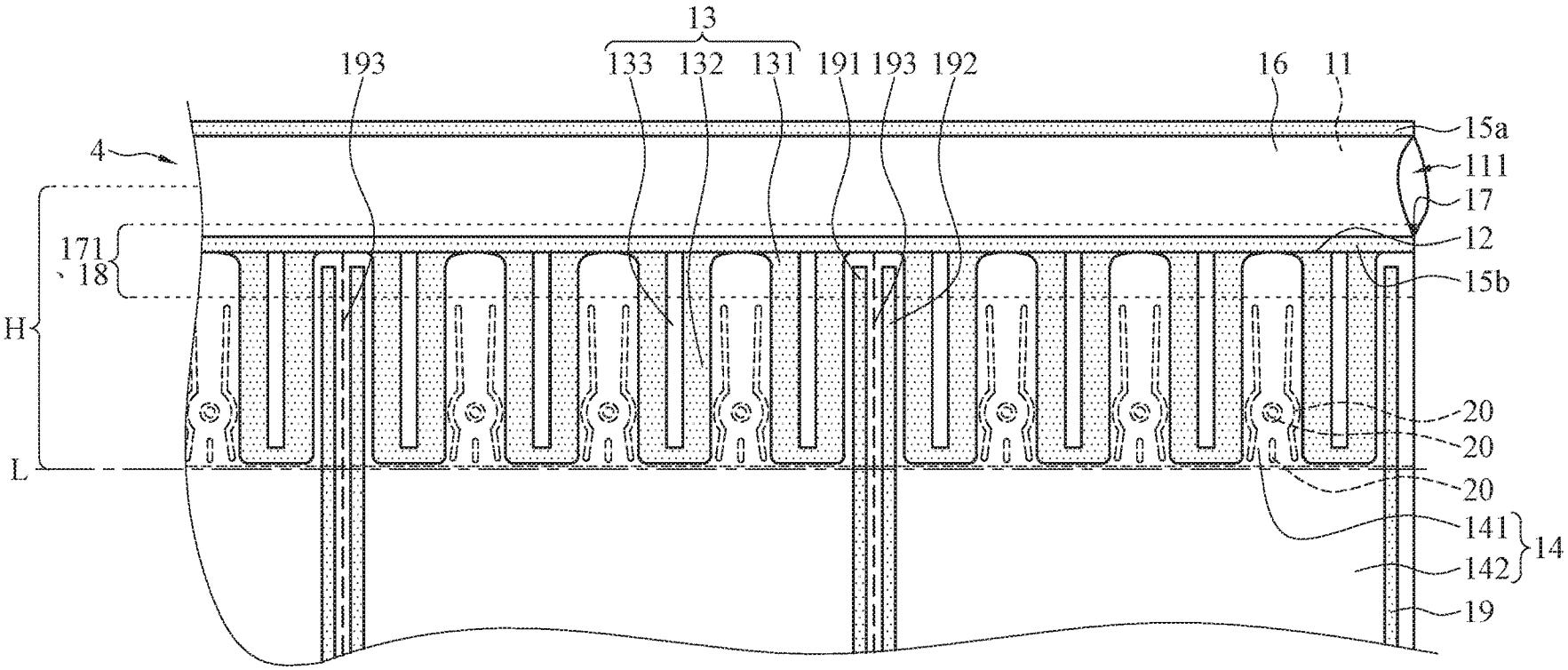
FIG. 2A illustrates a partial schematic view of a gas-sealed body according to one embodiment of the instant disclosure.
Figure 2B:
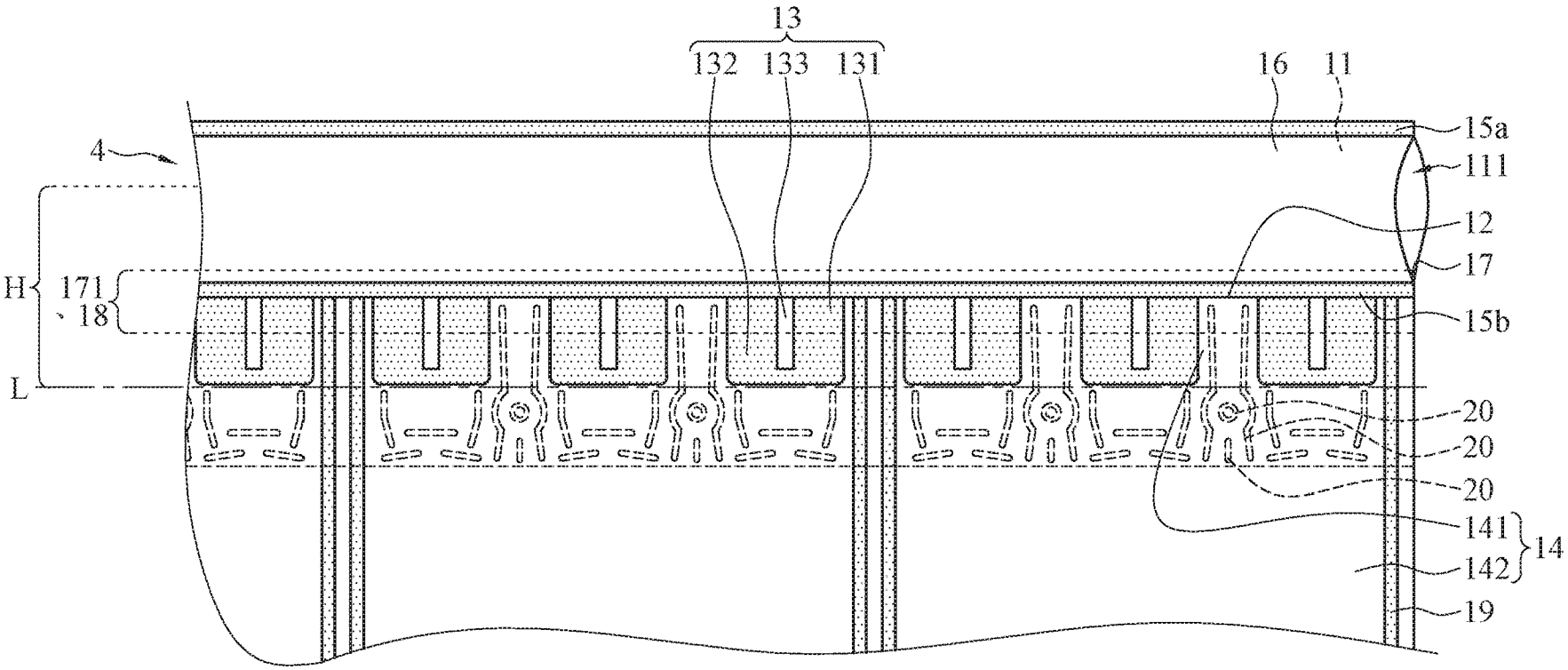
FIG. 2B illustrates a partial schematic view of a gas-sealed body according to one embodiment of the instant disclosure.
Figure 2C:
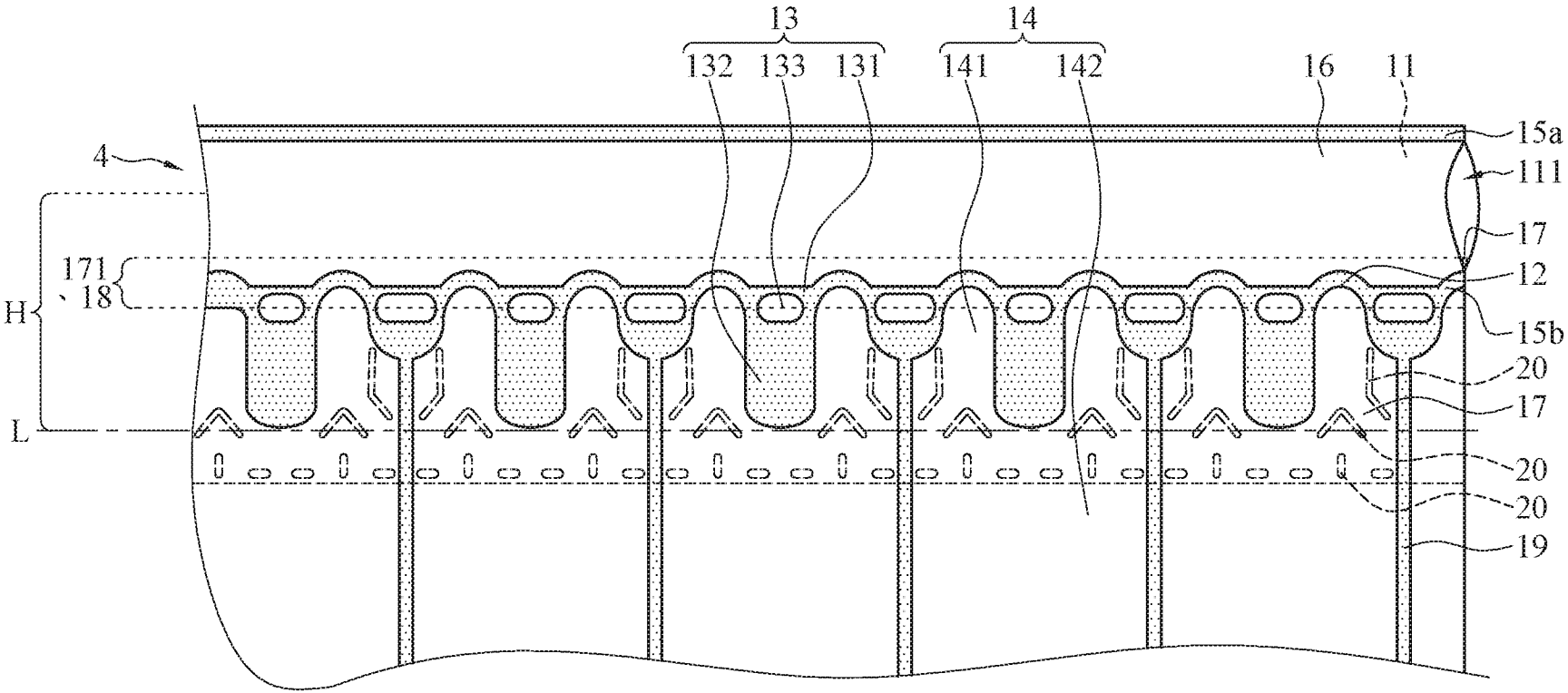
FIG. 2C illustrates a partial schematic view of a gas-sealed body according to one embodiment of the instant disclosure.
Figure 2D:
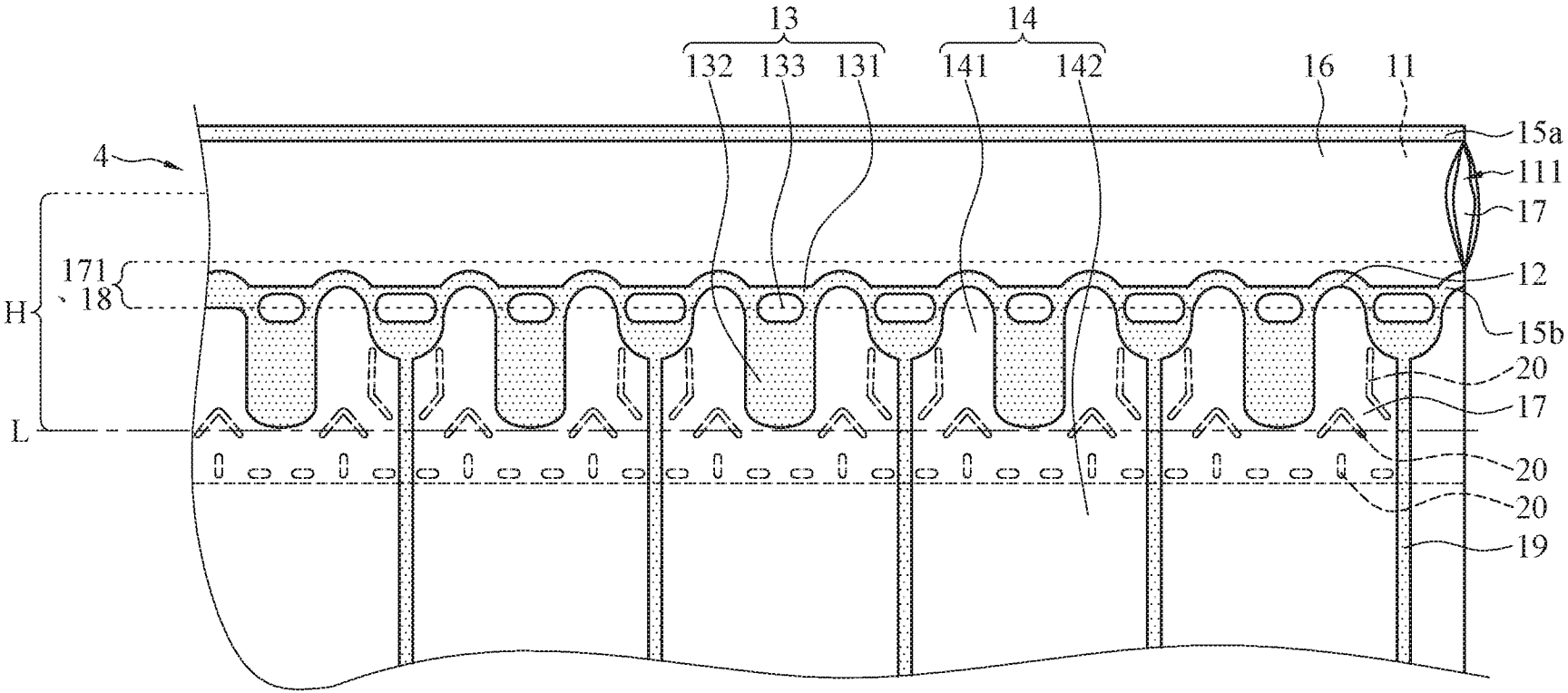
FIG. 2D illustrates a partial schematic view of a gas-sealed body according to one embodiment of the instant disclosure.

As shown in FIGS. 2A and 2C, in some embodiments, the inner films 17 and the outer films 16 do not have the same height (as shown in FIG. 2A, the borders of the inner films 17 are indicated by the upper dashed line of the heat-resistant area 171). The inner films 17 are located between the outer films 16, and one side of each of the inner films 17 is located in the inflation channel 11. In another embodiment, as shown in FIG. 2D, the inner films 17 and the outer films 16 have the same height. The first transversal heat-seal line 15*a* is adhered to the inner films 17 and the outer films 16, and the inflation channel 11 is formed between the two inner films 17.

In other words, in some embodiments, as shown in FIGS. 2A to 2C, top edge lines of the inner films 17 are flush with top edge lines of the outer films 16 (to each of the inner films 17, the top edge line is the edge line distant from the first transversal heat-seal line 15*a*). That is, heights of the inner films 17 (the scale of the inner films 17 along a direction perpendicular to the length direction of the first transversal heat-seal line 15*a*) are equal to heights of the outer films 16.

Conversely, as the embodiment shown in FIG. 2D, the top edge lines of the inner films 17 are lower than the top edge lines of the outer films 16. That is, the heights of the inner films 17 are lower than the heights of the outer films 16.

The gas inlets 12 are formed between the two inner films 17. One of opposite surfaces of the two inner films 17 has a heat-resistant area 171. After a heat-resistant material 18 is coated on the heat-resistant area 171, the gas inlets 12 are formed when the second transversal heat-seal line 15*b* is formed by heat sealing. The gas inlets 12 are at positions between the inner films 17, and the positions correspond to the heat-resistant material 18. The two inner films 17 are not adhered with each other at positions having the gas inlets 12. In other words, since the gas-sealed body 1 is coated with the heat-resistant material 18 at the gas inlets 12, the gas inlets 12 are not sealed during the heat sealing procedure.

As the embodiments shown in FIGS. 2A to 2D, a portion of the heat-resistant area 171 is on the inflation channel 11, and the second transversal heat-seal line 15*b* is in the heat-resistant area 171.

The pillow structures 13 are formed by heat sealing and spaced apart from each other. Each of the gas inlets 12 is located between two adjacent pillow structures 13. Each of the pillow structures 13 comprises an upper pillow portion 131 and a lower pillow portion 132 connected to the upper pillow portion 131. A bottom portion of each of the lower pillow portions 132 is connected to a rolling line L of the gas-sealed body 1 and the rolling line L is aligned transversally.

The gas chambers 14 are formed by intersecting a plurality of longitudinal heat-seal lines 19 with the second transversal heat-seal line 15*b*, and the longitudinal heat-seal lines 19 are spaced apart from each other. Therefore, the gas-sealed body 1 has several gas chambers 14 for gas storage. Each of the gas chambers 14 comprises at least one of the gas inlets 12, at least one cushion-part gas column 141, and a main-part gas column 142. Each of the cushion-part gas columns 141 is extending from the corresponding gas inlet 12 toward the rolling line L. Each of the main-part gas columns 142 communicates with the corresponding cushion-part gas column(s) 141 at the rolling line L. When the inflation bar 3 inflates each of the inflation inlets 12, the corresponding cushion-part gas column(s) 141 and the corresponding main-part gas column 142 are inflated and expanded in order.

In one embodiment, for one gas chamber 14, the number of the gas inlets 12 is two. Therefore, for one gas chamber 14, the number of the cushion-part gas columns 141 is two, while the number of the main-part gas column 142 is one.

As the embodiment shown in FIG. 1, the number of the gas inlets 12 in one gas chamber 14 is three; thus, in one gas chamber 14, the number of the cushion-part gas columns 141 is three, and one main-part gas column 142 is connected to the three cushion-part gas columns 141. Therefore, it is understood that, the number of the gas inlets 12 in one gas chamber 14 affects the number of the cushion-part gas columns 141 and the size of the main-part gas column 142. The larger the number of the gas inlets 12 in one gas chamber 14 is, the larger the number of the cushion-part gas columns 141 is, and the bigger the main-part gas column 142 is. Hence, the number of the cushion-part gas columns 141 and the size of the main-part gas column 142 can be adjusted according to user requirements, and embodiments are not limited thereto.

As shown in FIGS. 2A to 2D, in these embodiments, the heat-resistant material 18 is coated on the heat-resistant area 171 on one of the opposite surfaces of the two inner films 17, in a direction parallel to the length direction of the first transversal heat-seal line 15*a*, in a continuous coating manner. If the heat-resistant material 18 is coated on the heat-resistant area 171 in a continuous coating manner, an opening is firstly formed when the second transversal heat-seal line 15*b* is formed by heat sealing. Hence, when the pillow structures 13 are formed, each of the upper pillow portions 131 is located in the heat-resistant area 171, and each of the lower pillow portions 132 is located out of the heat-resistant area 171. The inflated gas does not go through the lower pillow portions 132, and the opening is divided into several gas inlets 12.

In another embodiment, the heat-resistant material 18 is coated on the heat-resistant area 171 on one of the opposite surfaces of the two inner films 17 in a discontinuous coating manner. For example, the heat-resistant material 18 is coated on the inner film 17 in a manner indicated by the dashed line or the heat-resistant material 18 forms several T-shaped portions spaced from each other, and the T-shaped portions are coated on the heat-resistant area 171. Accordingly, when the second transversal heat-seal line 15*b* is formed by heat sealing, a plurality of gas inlets 12 can be formed at the position of the gas-sealed body 1 having the heat-resistant material 18, but embodiments are not limited thereto.

Each of the pillow structures 13 comprises a cushioning node 133. The cushioning node 133 prevents wrinkles occurred to the outer films 16 and the inner films 17 due to the shrinkage of the outer films 16 and the inner films 17 during the formation of the pillow structures 13, and the cushioning node 133 also prevents the inner films 17 from flipping outwardly during the inflation of the gas-sealed body 1 to influence the conveyance and the inflation of the gas-sealed body 1. As shown in FIG. 2A, each of the pillow structures 13 is approximately of a rectangular shape. Each of the pillow structures 13 comprises an upper pillow portion 131 and a lower pillow portion 132 connected to the upper pillow portion 131. The upper pillow portion 131 is located in the heat-resistant area 171, and the lower pillow portion 132 is located out of the heat-resistant area 171. As the embodiment shown in FIG. 2B, in one embodiment, each of the pillow structures 13 is approximately of a square shape.

As indicated in the foregoing embodiments, the configuration of the pillow structure 13 affects the configuration of the cushion-part gas column 141. For example, in one embodiment, the width of the cushion-part gas column 141 changes from wide to narrow, and the narrower portion of the cushion-part gas column 141 is connected to the main-part gas column 142. In another embodiment, the width of the cushion-part gas column 141 changes from narrow to wide, and the wider portion of the cushion-part gas column 141 is connected to the main-part gas column 142. In other words, the configuration of the pillow structure 13 is not limited, and the pillow structure 13 may have a geometric shape. In some embodiments, the pillow structure 13 may be a block; alternatively, the pillow structure 13 may be of a rectangular shape, or a triangular shape, or a U shape, or a quadrilateral shape, or a V shape, or at least two of the foregoing; the shape of the pillow structure 13 depends on the user requirements. As the embodiment shown in FIG. 2C, the bottom portion of the pillow structure 13 is approximately of an arc shape, or a U shape. In one embodiment, the bottom portion of the pillow structure 13 is approximately of a V shape.

Furthermore, in some embodiments, the gas-sealed body 1 further comprises a plurality of heat-seal portions 20. Each of the heat-seal portions 20 is adhered to the inner films 11 and one of the outer films 12 in the corresponding main-part gas column 142. Each of the heat-seal portions 20 comprises a heat-seal point, or each of the heat-seal portions 20 comprises a heat-seal line, or each of the heat-seal portions 20 comprises a heat-seal point and a heat-seal line. The configuration of the heat-seal portion 20, as indicated in FIG. 2C, may have different combinations. The heat-seal portions 20 are used to adhere the inner films 17 with one of the outer films 16. Therefore, during the inflation of the gas-sealed body 1, after the main-part gas column 142 is inflated and expanded, the adhered inner films 17 as well as the adhered outer film 16 are attached with each other to close the gas inlets 12. Therefore, gas reflow conditions can be prevented.

Please refer to FIG. 2A again. Each of the longitudinal heat-seal line 19 comprises a first longitudinal heat-seal line portion 191 and a second longitudinal heat-seal line portion 192, and a longitudinal tear line 193 is between the first longitudinal heat-seal line portion 191 and the second longitudinal heat-seal line portion 192. Accordingly, according to the actual demand, the manufacturers or the users can cut or tear the gas-sealed body 1 along the tear line 19; for example, one can just tear or cut the inflated portion of the gas-sealed body 1 from the uninflated portion of the gas-sealed body 1 along the tear line and does not need to inflate the entire gas-sealed body and then cut the inflated gas-sealed body into portions.

Please refer to FIG. 3, illustrating a schematic operational view of a gas-sealed body 1 according to one embodiment of the instant disclosure. The gas-sealed body 1 is inflated by a processing machine 3 for further use. The processing machine 3 comprises an inflation bar 32 and a plurality of pressing wheels 31 adjacent to the inflation bar 32. The inflation bar 32 is adapted to inflate the gas-sealed body 1, and the pressing wheels 31 are adapted to roll on a rolling track 4 of the gas-sealed body 1 for conveying the gas-sealed body 1.

As mentioned, the gas-sealed body 1 comprises the pillow structures 13; each of the pillow structures 13 comprises an upper pillow portion 131 and a lower pillow portion 132 connected to the upper pillow portion 131; the upper pillow portion 131 is located in the heat-resistant area 171; the lower pillow portion 132 is located out of the heat-resistant area 171, and the bottom portion of each of the lower pillow portions 132 is aligned with the transversally-aligned rolling line L. A width range H of the rolling track 4 encompasses the rolling line L and at least a portion of the inflation channel 11; namely, the width range H of the rolling track 4 may encompass the rolling line L and a portion of the inflation channel 11 or the rolling line L and the entire inflation channel 11; that is, the width range H of the rolling track 4 at least equals to a distance between a portion of the inflation channel 11 and the rolling line L along the width direction of the inflation channel 11. Accordingly, the pillow structures 13 are similar to pillows on a track, so that the pillow structures 13 can be pressed by and positioned with the pressing wheels 31 stably to allow a pressure from the pressing wheels 31 to be distributed over the gas-sealed body 1. Furthermore, the cushion-part gas columns 141 provide a holding force for the pressing wheels 31, so that the pressing wheels 31 can be positioned with the cushion-part gas columns 141 when the pressing wheels 31 roll on the gas-sealed body 1.

Please refer to FIG. 2C. In this embodiment, the second transversal heat-seal line 15*b* forms curved structures at the gas inlets 12. Therefore, the shape of the cushion-part gas column 141 is changed. Specifically, in this embodiment, after the gas-sealed body 1 is inflated and expanded, portions of the second transversal heat-seal line 15*b* corresponding to the gas inlets 12 are protruding toward the first transversal heat-seal line 15*a*. Hence, the shape of the cushion-part gas column 141 shown in FIG. 2C can be different from the shape of the cushion-part gas column 141 shown in FIGS. 2A and 2B. In this embodiment, such configuration further properly provides the tension force of the pressing wheels 31 for the conveyance of the gas-sealed body 1, the holding force for the pressing wheels 31, and the abutting force of the pressing wheels 31 applied to the gas-sealed body 1.

In other words, the second transversal heat-seal line 15*b* may be a linear line or may be a line with curved lines or bent lines, as shown in FIGS. 2C and 2D.

In one embodiment, the width range H of the rolling track 4 may further encompass the first transversal heat-seal line 15*a*; that is, the width range H of the rolling track equals to a distance between the first transversal heat-seal line 15*a* and the rolling line 4. The width range H of the rolling track 4 depends on the configuration of the pressing wheels 31 of the processing machine 3, but embodiments are not limited thereto.

Without the pillow structures 13 and the cushion-part gas columns 141, the inflation bar 32 will directly inflate the main-part gas column 142. Once the main-part gas column 142 is inflated and expanded, the pressing wheels 31 cannot abut against the gas-sealed body 1 properly. As a result, the gas-sealed body 1 is deflected off the track. According to one or some embodiments of the instant disclosure, the gas-sealed body 1 has the pillow structures 13 and the cushion-part gas columns 141. Therefore, during the inflation, the pillow structures 13 are provided to be pressed by and positioned with the pressing wheels 31 stably for the conveyance of the gas-sealed body 1, and the pillow structures 13 are provided to allow a pressure from the pressing wheels 31 to be distributed over the gas-sealed body 1; the cushion-part gas columns 141 provide the tension force of the pressing wheels 31 for the conveyance of the gas-sealed body 1, the holding force for the pressing wheels 31, and the abutting force of the pressing wheels 31 applied to the gas-sealed body 1. Therefore, the pressing wheels 31 can smoothly press on the gas-sealed body 1, and the gas-sealed body 1 is not deflected from the conveying track.

According to one or some embodiments of the instant disclosure, the gas-sealed body 1 has the pillow structures 13 and the cushion-part gas columns 141. Therefore, during the inflation, the pillow structures 13 are to be pressed by and positioned with the pressing wheels 31 stably for the conveyance of the gas-sealed body 1, and the pillow structures 13 are provided to allow a pressure from the pressing wheels 31 to be distributed over the gas-sealed body 1; the cushion-part gas columns 141 provide the tension force of the pressing wheels 31 for the conveyance of the gas-sealed body 1, the holding force for the pressing wheels 31, and the abutting force of the pressing wheels 31 applied to the gas-sealed body 1. Furthermore, the pressing wheels 31 are not directly in contact with the main-part gas column 142. Therefore, the pressing wheels 31 can properly convey the gas-sealed body 1 and both the inflated portion and the uninflated portion of the gas-sealed body 1 can be smoothly conveyed.

What is claimed is:

1. A gas-sealed body with cushioning function, the gas-sealed body being adapted to be inflated by a processing machine, wherein the processing machine comprises an inflation bar and a plurality of pressing wheels adjacent to the inflation bar, the inflation bar is adapted to inflate the gas-sealed body, and the pressing wheels are adapted to roll on a rolling track of the gas-sealed body for conveying the gas-sealed body, the gas-sealed body comprising:

two outer films and two inner films, wherein the inner films are between the outer films, and a length of each of the inner films is shorter than a length of each of the outer films;

an inflation channel formed between a first transversal heat-seal line and a second transversal heat-seal line of the gas-sealed body, wherein the first transversal heat-seal line and the second transversal heat-seal line are not intersected with each other, the inflation channel comprises an inflation port, and the inflation bar is adapted to be put in the inflation port;

a plurality of gas inlets formed between the two inner films, wherein one of opposite surfaces of the two inner films has a heat-resistant area;

after a heat-resistant material is coated on the heat-resistant area, the gas inlets are formed when the second transversal heat-seal line is formed by heat sealing; wherein the gas inlets are at positions between the inner films and the positions correspond to the heat-resistant material, and the two inner films are not adhered with each other at positions having the gas inlets;

a plurality of pillow structures formed by heat sealing and spaced apart from each other, wherein each of the gas inlets is located between two adjacent pillow structures, each of the pillow structures comprises an upper pillow portion and a lower pillow portion connected to the upper pillow portion, the upper pillow portion is located in the heat-resistant area, the lower pillow portion is located out of the heat-resistant area, each of the outer films adheres with the inner films at the lower pillow portion, a bottom portion of the lower pillow portion is connected to a rolling line of the gas-sealed body, and the rolling line is aligned transversally, a width range of the rolling track encompasses the rolling line and at least a portion of the inflation channel, and the pillow structures are adapted to be pressed by and positioned with the pressing wheels stably to allow a pressure from the pressing wheels to be distributed over the gas-sealed body when the pressing wheels roll on the pillow structures; and a plurality of gas chambers formed by intersecting a plurality of longitudinal heat-seal lines with the second transversal heat-seal line, wherein the longitudinal heat-seal lines are spaced apart from each other;

each of the gas chambers comprises at least one of the gas inlets, at least one cushion-part gas column, and a main-part gas column, wherein the at least one cushion-part gas column is located and defined between adjacent two of the pillow structures, and extends from the corresponding gas inlet toward the rolling line, the main-part gas column communicates with the at least one cushion-part gas column at the rolling line, when the inflation bar inflates each of the inflation inlets, the at least one cushion-part gas column and the main-part gas column are inflated and expanded in order, and the at least one cushion-part gas column provides a holding force for the pressing wheels when the pressing wheels roll on the gas-sealed body.

2. The gas-sealed body according to claim 1, wherein the second transversal heat-seal line forms curved structures at the gas inlets.

3. The gas-sealed body according to claim 1, wherein the width range of the rolling track further encompasses the first transversal heat-seal line.

4. The gas-sealed body according to claim 1, wherein the heat-resistant material is coated on the heat-resistant area of one of the inner films in a continuous coating manner.

5. The gas-sealed body according to claim 1, wherein the heat-resistant material is coated on the heat-resistant area of one of the inner films in a discontinuous coating manner.

6. The gas-sealed body according to claim 1, wherein each of the longitudinal heat-seal lines comprises a first longitudinal heat-seal line portion and a second longitudinal heat-seal line portion, and a longitudinal tear line is between the first longitudinal heat-seal line portion and the second longitudinal heat-seal line portion.

7. The gas-sealed body according to claim 1, wherein top edge lines of the inner films are flush with top edge lines of the outer films, heights of the inner films are equal to heights of the outer films, and the inflation channel is formed between the inner films.

8. The gas-sealed body according to claim 1, wherein top edge lines of the inner films are lower than top edge lines of the outer films, heights of the inner films are lower than heights of the outer films, and the top edge lines of the inner films are located in the inflation channel.

9. The gas-sealed body according to claim 1, wherein each of the pillow structures is of a rectangular shape, or a triangular shape, or a U shape, or a quadrilateral shape, or a V shape, or a combination comprising at least two of the foregoing.

10. The gas-sealed body according to claim 1, further comprising a plurality of heat-seal portions each adhered to the inner films and one of the outer films in the corresponding main-part gas column, wherein each of the heat-seal portions comprises a heat-seal point, or each of the heat-seal portions comprises a heat-seal line, or each of the heat-seal portions comprises a heat-seal point and a heat-seal line.

* * * * *